US006820579B2

(12) United States Patent
Kawamura et al.

(10) Patent No.: US 6,820,579 B2
(45) Date of Patent: Nov. 23, 2004

(54) VARIABLE VALVE OPERATING SYSTEM OF ENGINE ENABLING VARIATION OF WORKING ANGLE AND PHASE

(75) Inventors: Katsuhiko Kawamura, Yokohama (JP); Takeshi Etoh, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/452,252

(22) Filed: Jun. 3, 2003

(65) Prior Publication Data

US 2004/0011313 A1 Jan. 22, 2004

(30) Foreign Application Priority Data

Jul. 22, 2002 (JP) ..... 2002-211993

(51) Int. Cl.[7] ..... F01L 1/34
(52) U.S. Cl. ..... 123/90.16; 123/90.15
(58) Field of Search ..... 123/90.16, 90.15, 123/90.17, 90.31

(56) References Cited

U.S. PATENT DOCUMENTS 6,647,935 B2 * 11/2003 Aoyama et al. ..... 123/90.16
2002/0129780 A1 * 9/2002 Nohara et al. ..... 123/90.16

FOREIGN PATENT DOCUMENTS

JP 2001-280167 A 10/2001
JP 2002-89303 A 3/2002

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

In a variable intake-valve operating system for an engine enabling a working angle of an intake valve and a phase at a maximum lift point of the intake valve to be varied, a variable working-angle control mechanism is provided to continuously change the working angle of the intake valve and a variable phase control mechanism is provided to continuously change the phase of the intake valve. A control unit is configured to be electronically connected to both the two variable control mechanisms, to simultaneously control these control mechanisms responsively to a desired working angle and a desired phase both based on an engine operating condition. The control unit executes a synchronous control that a time rate of change of the working angle and a time rate of change of the phase are synchronized with each other in a transient state that the engine operating condition changes.

21 Claims, 13 Drawing Sheets

FIG.3A
DURING LOW LOAD
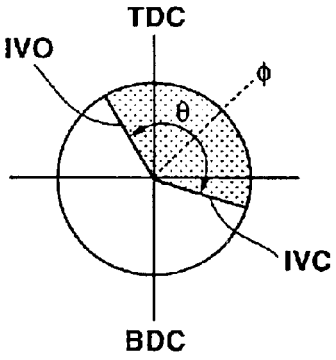
FIG.3B
DURING HIGH LOAD
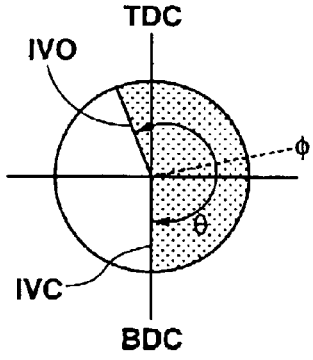
FIG.4A
FIG.4B
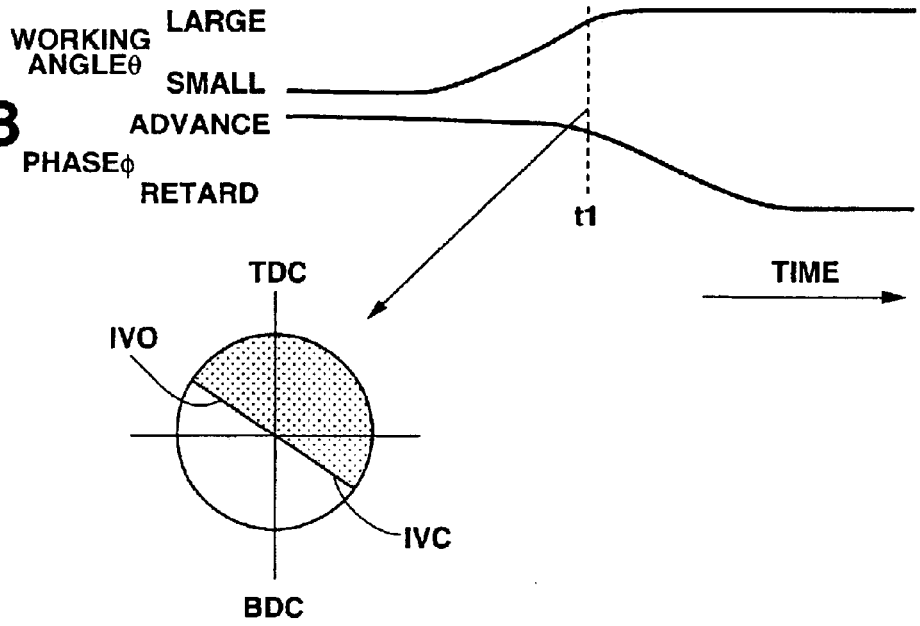

FIG.8A
FIG.8B
FIG.8C
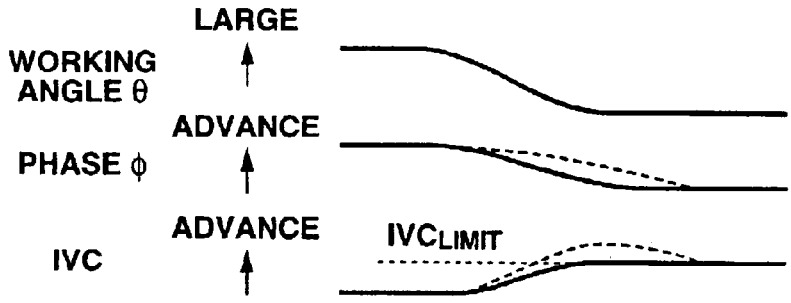
FIG.9A
FIG.9B
FIG.9C
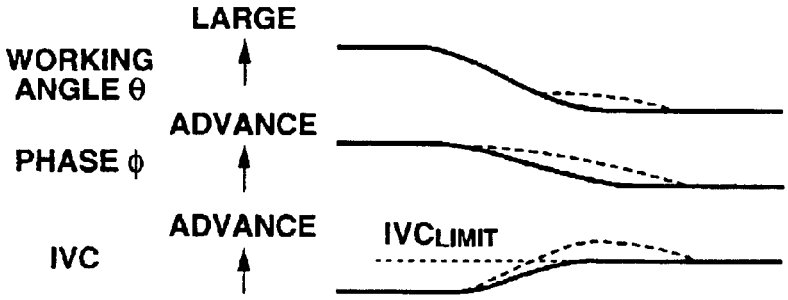

FIG.11A
FIG.11B
FIG.11C
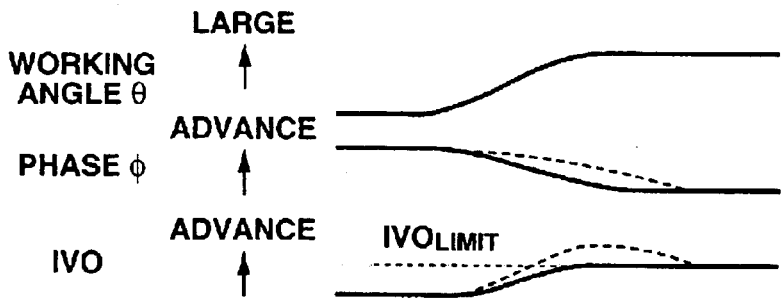
FIG.12A
FIG.12B
FIG.12C
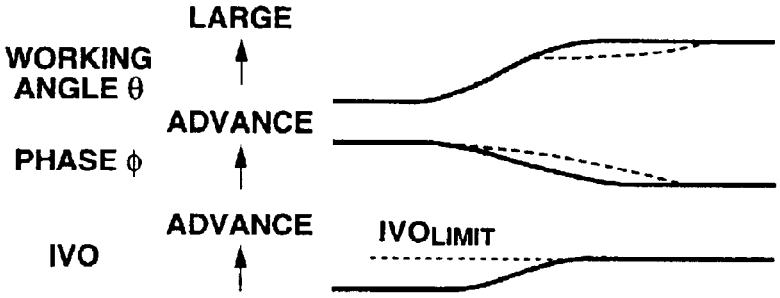

FIG.14A
FIG.14B
FIG.14C
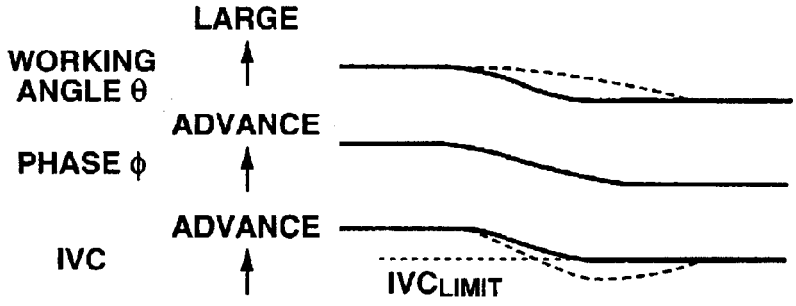
FIG.15A
FIG.15B
FIG.15C
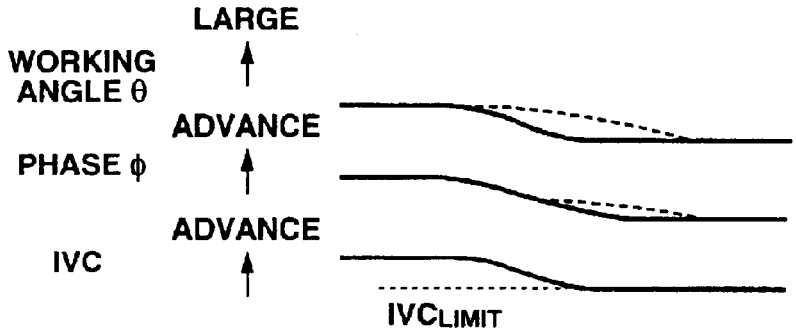

FIG.17A
FIG.17B
FIG.17C
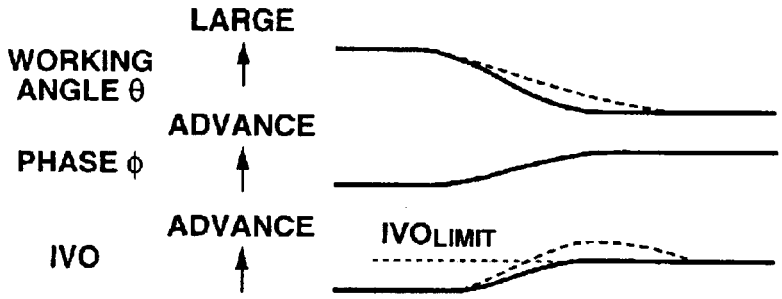
FIG.18A
FIG.18B
FIG.18C
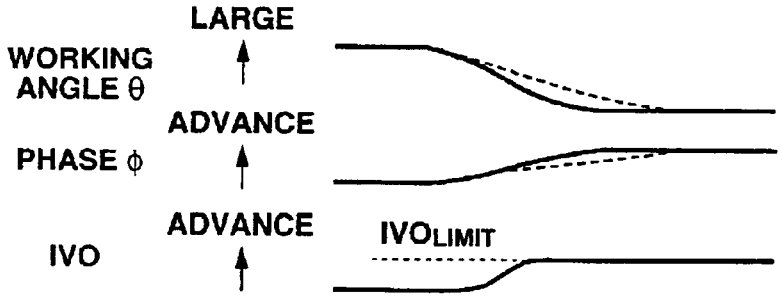

VARIABLE VALVE OPERATING SYSTEM OF ENGINE ENABLING VARIATION OF WORKING ANGLE AND PHASE

TECHNICAL FIELD

The present invention relates to a variable valve operating system of an engine enabling working angle and phase to be varied, and specifically to a variable valve operating system of an internal combustion engine employing a variable working angle control mechanism and a variable phase control mechanism both used for an intake valve.

BACKGROUND ART

In recent years, there have been proposed and developed various variable valve operating systems enabling both working angle and phase to be varied for a high degree of freedom of valve lift characteristics and enhanced engine performance through all engine operating conditions. Such variable valve operating systems have been disclosed in Japanese Patent Provisional Publication Nos. 2001-280167 (hereinafter is referred to as "JP2001-280167") and 2002-89303 (hereinafter is referred to as "JP2002-89303"). In the system disclosed in each of JP2001-280167 and JP2002-89303, a hydraulically-operated variable working angle control mechanism is provided to continuously extract or contract a working angle of an intake valve, and a hydraulically-operated variable phase control mechanism is provided to retard or advance the angular phase at the maximum intake-valve lift point (often called "central-angle phase"). In particular, in the system of JP2001-280167, to avoid a rapid drop in hydraulic pressure, that is, an excessive load on an oil pump serving as a hydraulic pressure source common to both the variable working angle control mechanism and the variable phase control mechanism, a control system inhibits the two control mechanisms from being driven simultaneously in specified transient states, such as in presence of a transition from low to high load or in presence of a transition from high to low load. In other words, in the system of JP2001-280167, when the working angle and the central-angle phase have both to be varied greatly during the transient state, the control system first drives one of the two control mechanisms and then drives the other with a time delay.

SUMMARY OF THE INVENTION

In such a variable valve operating system employing both a first actuator for a variable working angle control mechanism and a second actuator for a variable phase control mechanism, a certain valve lift characteristic is realized or achieved by way of a combination of a change in working angle adjusted by the first actuator and a change in central-angle phase adjusted by the second actuator. The inventors have discovered that, in the transient state, i.e., in presence of a remarkable engine load change, a variation of working angle (in particular, a time rate of change of working angle adjusted by the first actuator) is not always identical to a variation of central-angle phase (in particular, a time rate of change of central-angle phase adjusted by the second actuator), and therefore there is an increased tendency for a transient valve lift characteristic to deviate from a desired valve lift characteristic. Such a deviation leads to excessive valve overlap, reduced combustion stability, increased combustion deposits or undesired torque fluctuations. Thus, it is desirable to more precisely optimize a valve lift characteristic, which is determined by the working angle and central-angle phase, in transient states, for example, in presence of a transition from low to high load or a transition from high to low load.

Accordingly, it is an object of the invention to provide a variable valve operating system of an engine employing a variable working angle control mechanism and a variable phase control mechanism both used for an intake valve, capable of optimizing a valve lift characteristic, which is determined by the working angle and central-angle phase, in transient states, for example, in presence of a remarkable change in engine load.

In order to accomplish the aforementioned and other objects of the present invention, a variable intake-valve operating system for an engine enabling a working angle of an intake valve and a phase at a maximum lift point of the intake valve to be varied, comprises a variable working-angle control mechanism capable of continuously changing the working angle of the intake valve, a variable phase control mechanism capable of continuously changing the phase of the intake valve, a control unit being configured to be electronically connected to both the variable working-angle control mechanism and the variable phase control mechanism, to simultaneously control the variable working-angle control mechanism and the variable phase control mechanism responsively to a desired working angle and a desired phase both based on an engine operating condition, and the control unit executing a synchronous control that a time rate of change of the working angle and a time rate of change of the phase are synchronized with each other in a transient state that the engine operating condition changes.

According to another aspect of the invention, a variable intake-valve operating system for an engine enabling a working angle of an intake valve and a phase at a maximum lift point of the intake valve to be varied, comprises a first actuating means for continuously changing the working angle of the intake valve, a second actuating means for continuously changing the phase of the intake valve, a control unit being configured to be electronically connected to both the first and second actuating means, for simultaneously controlling the first and second actuating means responsively to a desired working angle and a desired phase both based on an engine operating condition, and the control unit executing a synchronous control that a time rate of change of the working angle and a time rate of change of the phase are synchronized with each other in a transient state that the engine operating condition changes.

According to a still further aspect of the invention, a method of controlling a variable intake-valve operating system for an engine enabling a working angle of an intake valve and a phase at a maximum lift point of the intake valve to be varied continuously, the method comprises initiating a working angle control, so that the working angle is brought closer to a desired working angle, initiating a phase control in parallel with the working angle control, so that the phase is brought closer to a desired phase, and executing a synchronous control between the working angle control and the phase control, so that a time rate of change of the working angle and a time rate of change of the phase are synchronized with each other in a transient state that an engine operating condition changes.

The other objects and features of this invention will become understood from the following description with reference to the accompanying drawings.

BRIEF DESCRIPTION OF THE DRAWINGS

FIG. 3A is an intake-valve characteristic diagram showing an open timing IVO and a closure timing IVC of the intake valve, a working angle θ from IVO to IVC, and a central-angle phase ϕ at the maximum intake-valve lift point, at low engine load operation.

FIG. 3B is an intake-valve characteristic diagram showing IVO, IVC, θ, and ϕ at high engine load operation.

FIG. 4A shows an example of an unpreferable intake valve timing characteristic that there is a time delay of a change of central-angle phase ϕ with respect to a change of working angle θ, during acceleration in a first transient state from low to high load.

FIG. 4B is an intake-valve characteristic diagram showing IVO and IVC, in the 1st transient state.

FIGS. 8A, 8B, and 8C are time charts respectively showing a change in working angle θ, a change in central-angle phase ϕ, and a change in intake-valve closure timing IVC, obtained with no synchronous control for working angle and phase in the 2nd transient state.

FIGS. 9A, 9B, and 9C are time charts respectively showing a change in working angle θ, a change in central-angle phase ϕ, and a change in intake-valve closure timing IVC, obtained with synchronous control for working angle and phase in the 2nd transient state.

FIGS. 11A, 11B, and 11C are time charts respectively showing a change in working angle θ, a change in central-angle phase ϕ, and a change in intake-valve closure timing IVC, obtained with no synchronous control for working angle and phase in the 3rd transient state.

FIGS. 12A, 12B, and 12C are time charts respectively showing a change in working angle θ, a change in central-angle phase ϕ, and a change in intake-valve closure timing IVC, obtained with synchronous control for working angle and phase in the 3rd transient state.

FIGS. 14A, 14B, and 14C are time charts respectively showing a change in working angle θ, a change in central-angle phase ϕ, and a change in intake-valve closure timing IVC, obtained with no synchronous control for working angle and phase in the 4th transient state.

FIGS. 15A, 15B, and 15C are time charts respectively showing a change in working angle θ, a change in central-angle phase ϕ, and a change in intake-valve closure timing IVC, obtained with synchronous control for working angle and phase in the 4th transient state.

FIGS. 17A, 17B, and 17C are time charts respectively showing a change in working angle θ, a change in central-angle phase ϕ, and a change in intake-valve closure timing IVC, obtained with no synchronous control for working angle and phase in the 5th transient state.

FIGS. 18A, 18B, and 18C are time charts respectively showing a change in working angle θ, a change in central-angle phase ϕ, and a change in intake-valve closure timing IVC, obtained with synchronous control for working angle and phase in the 5th transient state.

DESCRIPTION OF THE PREFERRED EMBODIMENTS

Figure 1:
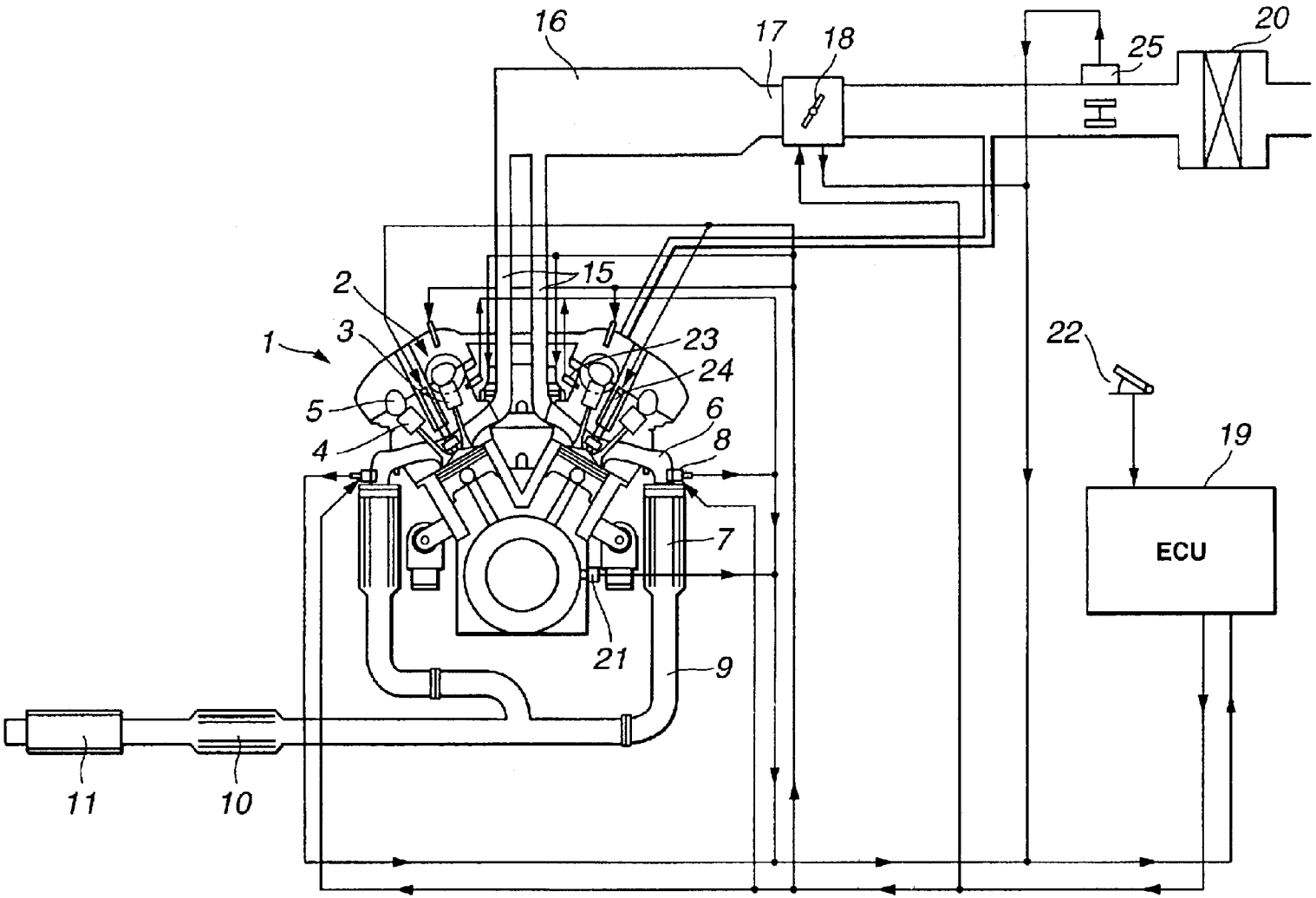
FIG. 1 is a system block diagram illustrating an embodiment of a variable valve operating system of an engine employing a variable working angle control mechanism and a variable phase control mechanism both used for an intake valve.

Referring now to the drawings, particularly to FIG. 1, the variable valve operating system of the embodiment is exemplified in a V-6 four-cycle spark-ignited gasoline engine 1 with an engine crankshaft and two cylinder banks having three pair of cylinders whose centerlines are set at a predetermined bank angle to each other. As shown in FIG. 1, a variable valve operating device 2 is provided inside of each of the left and right banks, so that intake valves 3 of the two banks are driven by means of respective variable valve operating devices 2. Thus, as fully described later, an intake-valve lift characteristic is variable. On the other hand, a valve operating mechanism for an exhaust valve 4 of each cylinder bank is constructed as a direct-operated valve operating mechanism that exhaust valve 4 is driven directly by an exhaust camshaft 5. An exhaust-valve lift characteristic is fixed (constant). Left-bank and right-bank exhaust manifolds 6, 6 are connected to respective catalytic converters 7, 7. A pair of air/fuel (A/F) ratio sensors (Lambda sensors or oxygen sensors) 8, 8 are provided at respective upstream sides of catalytic converters 7, 7, for monitoring or detecting the percentage of oxygen contained within engine exhaust gases, that is, an air/fuel mixture ratio. Left-bank and right-bank exhaust passages 9, 9 are combined to each other as a single exhaust pipe, downstream of the respective catalytic converter. A second catalytic converter 10 and a muffler 11 are disposed downstream of the single exhaust pipe. Left-bank and right-bank intake-manifold branch passages (six branches 15) are connected at downstream ends to the respective intake ports. The upstream ends of the six intake-manifold branches 15 are connected to a collector 16. Collector 16 is connected at its upstream end to an intake-air inlet passage 17. An electronically-controlled throttle valve 18 is provided in inlet passage 17. Although it is not clearly shown in the drawing, electronically-controlled throttle valve unit 18 is comprised of a round-disk throttle valve, a throttle position sensor, and a throttle actuator that is driven by means of an electric motor such as a step motor. The throttle actuator adjusts the throttle opening in response to a control command signal from an electronic engine control unit (ECU) 19. The throttle position sensor is provided to monitor or detect the actual throttle opening. As appreciated, in a conventional manner, with an electronic throttle control system having the throttle position sensor, the throttle actuator, and the throttle valve linked to the throttle actuator, the throttle opening can be adjusted or controlled to a desired throttle opening by way of closed-loop control (feedforward control). An airflow meter 25 is provided upstream of the throttle of electronically-controlled throttle valve unit 18 to measure or detect a quantity of intake air. An air cleaner 20 is further provided upstream of airflow meter 25. A crank-angle sensor (or a crankshaft position sensor) 21 is provided to inform the ECU of engine speed as well as the relative position of the engine crankshaft (i.e., a crankangle). An accelerator position sensor 22 is provided to monitor or detect an amount of depression of an accelerator pedal depressed by the driver, that is, an accelerator opening. ECU 19 generally comprises a microcomputer. ECU 19 includes an input/output interface (I/O), memories (RAM, ROM), and a microprocessor or a central processing unit (CPU). The input/output interface (I/O) of ECU 19 receives input information from engine/vehicle sensors, namely the throttle position sensor, Lambda sensor 8, crank position sensor 21, accelerator position sensor 22, airflow meter 25, a control shaft sensor 64 (described later), and a drive shaft sensor 66 (described later). Within ECU 19, the central processing unit (CPU) allows the access by the I/O interface of input informational data signals from the previously-discussed engine/vehicle sensors. The CPU of ECU 19 is responsible for carrying the fuel-injection/ignition-timing/intake-valve lift characteristic/throttle control program stored in memories and is capable of performing necessary arithmetic and logic operations. Concretely, based on the input information, a fuel-injection amount and a fuel-injection timing of a fuel injection valve or an injector 23 of each engine cylinder are controlled by an electronic fuel-injection control system. An ignition timing of a spark plug 24 of each engine cylinder is controlled by an electronic ignition system. The throttle opening of electronically-controlled throttle valve 18 is controlled by the electronic throttle control system containing the throttle actuator operated responsively to the control command from ECU 19. On the other hand, the intake-valve lift characteristic is electronically controlled by means of variable valve operating device 2, which is comprised of a variable lift working-angle control mechanism 51 and a variable phase control mechanism 71 (described later in detail). Computational results, that is, calculated output signals are relayed through the output interface circuitry of ECU 19 to output stages, namely the throttle actuator included in the electronic throttle control system (the engine output control system), the fuel injectors, the spark plugs, a first actuator for variable lift working-angle control mechanism 51, and a second actuator for variable phase control mechanism 71.

Figure 2:
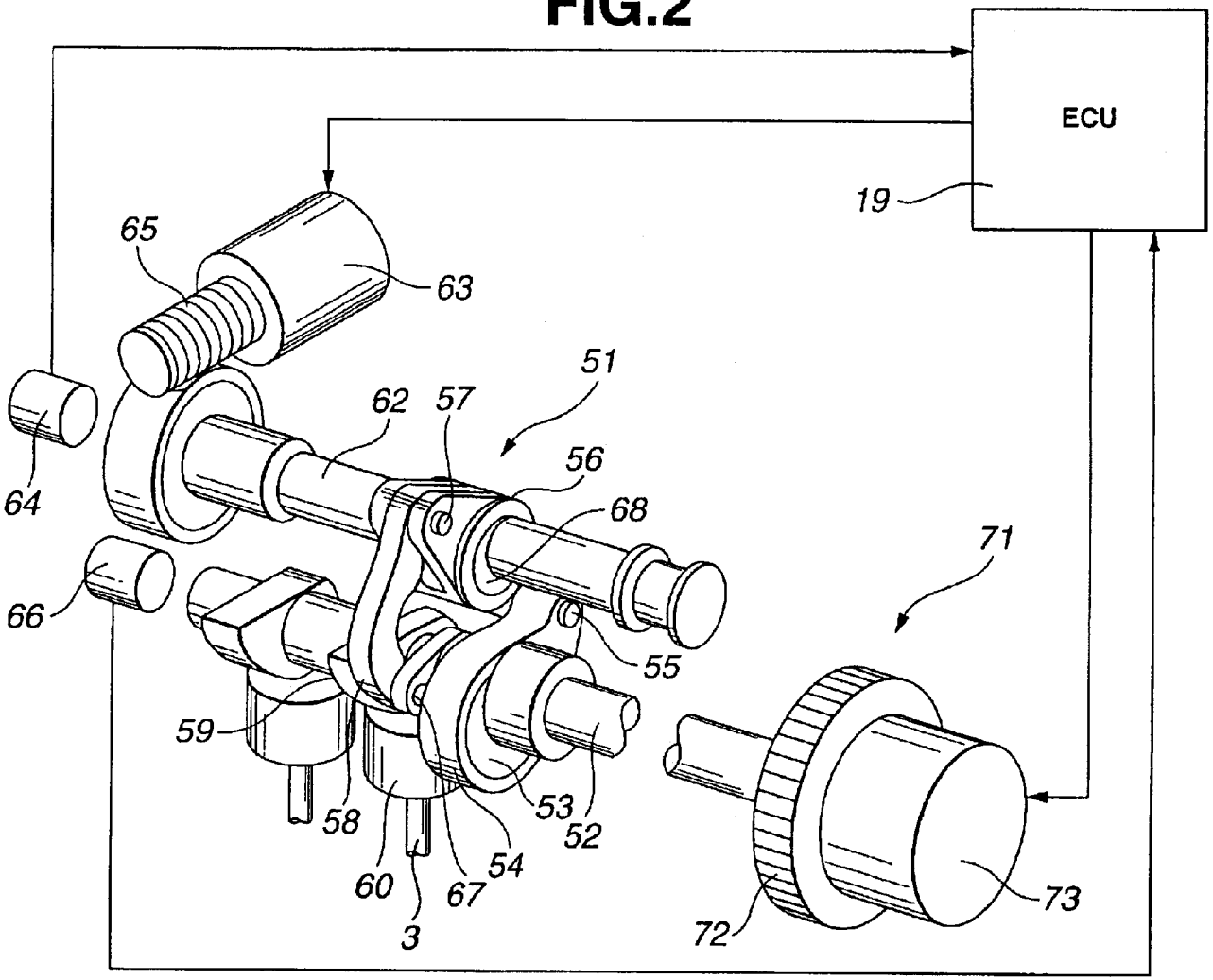
FIG. 2 is a perspective view illustrating the detailed construction of the variable valve operating system of the embodiment employing the variable working angle control mechanism and the variable phase control mechanism.

Referring now to FIG. 2, there is shown the detailed construction of variable valve operating device 2. As seen from the perspective view of FIG. 2, variable valve operating device 2 has variable lift working-angle control mechanism 51 and variable phase control mechanism 71, combined to each other. Variable lift working-angle control mechanism 51 is provided to continuously change a valve lift of intake valve 3 and a working angle $\theta$ of intake valve 3. On the other hand, variable phase control mechanism 71 is provided to change an angular phase at the maximum intake-valve lift point, that is, a central-angle phase $\phi$.

Variable lift working-angle control mechanism 51 includes the intake valve slidably installed on the cylinder head, a drive shaft 52 rotatably supported by a cam bracket (not shown) mounted on the upper portion of the cylinder head, an eccentric cam 53 press-fitted onto drive shaft 52, a control shaft 62 having an eccentric cam portion 68 whose axis is eccentric to the axis of control shaft 62, which is located above the drive shaft 52, rotatably supported by the same cam bracket, and arranged in parallel with drive shaft 52, a rocker arm 56 rockably supported on the eccentric cam portion 68 of control shaft 62, and a rockable cam 59 in sliding-contact with a tappet (a valve lifter) 60 of intake valve 3. Eccentric cam 53 is mechanically linked to rocker arm 56 via a link arm 54, and additionally rocker arm 56 is mechanically linked to rockable cam 59 via a link member 58. Drive shaft 52 is driven by the engine crankshaft via a timing chain or a timing belt. Eccentric cam 53 has a cylindrical outer peripheral surface. The axis of eccentric cam 53 is eccentric to the axis of drive shaft 52 by a predetermined eccentricity. The inner periphery of the annular portion of link arm 54 is rotatably fitted onto the cylindrical outer periphery of eccentric cam 53. The substantially central portion of rocker arm 56 is rockably supported by the eccentric cam portion 68 of control shaft 62. One end of rocker arm 56 is mechanically linked to or pin-connected to the armed portion of link arm 54 via a connecting pin 55. The other end of rocker arm 56 is mechanically linked to or pin-connected to the upper end of link member 58 via a connecting pin 57. As discussed above, the axis of eccentric cam portion 68 is eccentric to the axis of control shaft 62 by a predetermined eccentricity. Thus, the center of oscillating motion of rocker arm 56 changes depending upon the angular position of control shaft 62. Rockable cam 59 is rotatably fitted onto the outer periphery of drive shaft 52. One end of rockable cam 59, extending in the direction normal to the axis of drive shaft 52, is linked to or pin-connected to the lower end of link member 58 via a connecting pin 67. Rockable cam 59 is formed on its lower surface with a base-circle surface portion being concentric to drive shaft 52 and a moderately-curved cam surface portion being continuous with the base-circle surface portion. The base-circle portion and the cam surface portion of rockable cam 59 are designed to be brought into abutted-contact (or sliding-contact) with a designated point of the upper face of tappet 60 of intake valve 3, depending on an angular position of rockable cam 59 oscillating. In this manner, the base-circle surface portion serves as a base-circle section within which an intake-valve lift is zero. On the other hand, a predetermined angular range of the cam surface portion, being continuous with the base-circle surface portion, serves as a ramp section. Additionally, a predetermined angular range of the cam nose portion being continuous with the ramp section serves as a lift section. As clearly shown in FIG. 2, control shaft 62 of variable lift and working-angle control mechanism 51 is driven within a predetermined angular range by means of the first actuator (a lift and working-angle control hydraulic actuator) 63. In the shown embodiment, the first actuator 63 is comprised of a servo motor, a worm gear 65 serving as an output shaft of the servo motor, a worm wheel in meshed-engagement with worm gear 65 and fixedly connected to the outer periphery of control shaft 62. The operation of the servo motor of first actuator 63 is electronically controlled in response to a control signal from ECU 19. In order to monitor or detect the angular position of control shaft 62, control shaft sensor 64 is located nearby control shaft 62. Actually, a controlled pressure applied to first actuator 63 is regulated or modulated by way of a first hydraulic control module (not shown), which is responsive to a control signal from the ECU. First actuator 63 is designed so that the angular position of the output shaft (worm gear 65) is forced toward and held at its initial angular position by means of a return spring with the first hydraulic control module de-energized. Variable lift and working-angle control mechanism 51 operates as follows.

During rotation of drive shaft 52, link arm 54 moves up and down by virtue of cam action of eccentric cam 53. The up- and- down motion of link arm 54 causes the oscillating motion of rocker arm 56. The oscillating motion of rocker arm 56 is transmitted via link member 58 to rockable cam 59 with the result that rockable cam 59 oscillates. By virtue of the cam action of rockable cam 59 oscillating, tappet 60 of intake valve 3 is pushed and thus intake valve 3 lifts. When the angular position of control shaft 62 is varied by first actuator 63, an initial position of rocker arm 56 varies and as a result an initial position (or a starting point) of the oscillating motion of rockable cam 59 also varies. Assuming that the angular position of the eccentric cam portion 68 of control shaft 62 is shifted from a first angular position that the axis of eccentric cam portion 68 is located just under the axis of control shaft 62 to a second angular position that the axis of eccentric cam portion 68 is located just above the axis of control shaft 62, as a whole rocker arm 56 shifts upwards. As a result, the end portion of rockable cam 59, including a hole for connecting pin 67, is relatively pulled upwards. That is, the initial position of rockable cam 59 is shifted such that the rockable cam itself is inclined in a direction that the cam surface portion of rockable cam 59 moves apart from intake-valve tappet 60. With rocker arm 56 shifted upwards, when rockable cam 59 oscillates during rotation of drive shaft 52, the base-circle surface portion of rockable cam 59 is held in contact with tappet 60 for a comparatively long time period. In other words, a time period during which the cam surface portion of rockable cam 59 is held in contact with tappet 60 becomes short. As a consequence, a valve lift of intake valve 3 becomes short. Additionally, a working angle θ (i.e., a lifted period) from intake-valve open timing IVO to intake-valve closure timing IVC becomes reduced.

Conversely, when the angular position of the eccentric cam portion 68 of control shaft 62 is shifted from the second angular position to the first angular position, as a whole rocker arm 56 shifts downwards. As a result of this, the end portion of rockable cam 59, including the hole for connecting pin 67, is relatively pulled downwards. That is, the initial position of rockable cam 59 is shifted such that the rockable cam itself is inclined in a direction that the cam surface portion of rockable cam 59 moves towards intake-valve tappet 60. With rocker arm 56 shifted downwards, when rockable cam 59 oscillates during rotation of drive shaft 52, a portion, which is brought into contact with intake-valve tappet 60, is somewhat shifted from the base-circle surface portion of rockable cam 59 to the cam surface portion of rockable cam 59. As a consequence, a valve lift of intake valve 3 becomes large. Additionally, working angle θ (i.e., a lifted period) from intake-valve open timing IVO to intake-valve closure timing IVC becomes extended.

The angular position of the eccentric cam portion 68 of control shaft 62 can be continuously varied within limits by means of first actuator 63, and thus valve lift characteristics (valve lift and working angle) also vary continuously. That is, variable lift and working-angle control mechanism 51 shown in FIG. 2 can scale up and down both the valve lift and the working angle continuously simultaneously. In other words, in accordance with a change in valve lift and a change in working angle θ, occurring simultaneously, it is possible to vary intake-valve open timing IVO and intake-valve closure timing IVC symmetrically with each other. Details of such a variable lift and working-angle control mechanism being set forth, for example, in U.S. Pat. No. 5,988,125 issued Nov. 23, 1999, the teachings of which are hereby incorporated by reference.

On the other hand, variable phase control mechanism 71 is comprised of a sprocket 72 and the second actuator (a phase control hydraulic actuator) 73. Sprocket 72 is provided at the front end of drive shaft 52. Second actuator 73 is provided to enable drive shaft 52 to rotate relative to sprocket 72 within a predetermined angular range. Sprocket 72 has a driven connection with the engine crankshaft through a timing chain (not shown) or a timing belt (not shown). In order to monitor or detect the angular position of drive shaft 52, drive shaft sensor 66 is located nearby drive shaft 52. Actually, a controlled pressure applied to second actuator 73 is regulated or modulated by way of a second hydraulic control module (not shown), which is responsive to a control signal from the ECU. The relative rotation of drive shaft 52 to sprocket 72 in one rotational direction results in a phase advance of the central-angle phase ϕ at the maximum intake-valve lift point. The relative rotation of drive shaft 52 to sprocket 72 in the opposite rotation direction results in a phase retard of the central-angle phase ϕ at the maximum intake-valve lift point. In variable phase control mechanism 71 shown in FIG. 2, only the central-angle phase ϕ at the maximum intake-valve lift point is advanced or retarded, with no valve-lift change of intake valve 3 and no working-angle change of intake valve 3. The relative angular position of drive shaft 52 to sprocket 72 can be continuously varied within limits by means of second actuator 73, and thus central-angle phase ϕ also can vary continuously. In the shown embodiment, each of first and second actuators 63 and 73 is comprised of a hydraulic actuator. In lieu thereof, each of first and second actuators 63 and 73 may be constructed by an electromagnetically-operated actuator.

As discussed above, variable valve operating device 2 incorporated in the system of the embodiment is constructed by both of variable lift and working-angle control mechanism 51 and variable phase control mechanism 71 combined to each other. Thus, it is possible to widely continuously vary the intake-valve lift characteristic, in particular intake-valve open timing IVO and intake-valve closure timing IVC, by way of a combination of the variable lift and working-angle control and the variable phase control.

FIG. 3A shows an example of intake-valve open timing IVO and intake-valve closure timing IVC, both determined by way of a combination of a working angle θ controlled by variable lift and working-angle control mechanism 51 and a central-angle phase ϕ controlled by variable phase control mechanism 71, under part-load. FIG. 3B shows an example of intake-valve open timing IVO and intake-valve closure timing IVC, both determined by way of a working angle θ and a central-angle phase ϕ, both suited for high load operation. As seen from the intake-valve characteristic diagrams of FIGS. 3A (under part-load) and 3B (under high load), the working angle θ at the high load is adjusted to be wider than that at the part load, whereas the central-angle phase ϕ at the high load is adjusted in the phase-retard direction in comparison with that at part load. Regarding the variable lift and working-angle control system containing first actuator 63 and ECU 19, in calculating a desired value of working angle θ of intake valve 3, an engine speed and a required engine torque are used as parameters of engine operating conditions. The desired value of working angle θ is computed or actually map-retrieved from a preprogrammed characteristic map showing how a desired working angle has to be varied relative to an engine speed and a required engine torque. Then, variable lift and working-angle control mechanism 51 is controlled responsively to a control signal corresponding to the desired working angle map-retrieved based on latest up-to-date information regarding the engine speed and required engine torque. Regarding the variable phase control system containing second actuator 73 and ECU 19, in calculating a desired value of central-angle phase $\phi$ of intake valve 3, an engine speed and a required engine torque are used as parameters of engine operating conditions. The desired value of central-angle phase $\phi$ is computed or actually map-retrieved from a preprogrammed characteristic map showing how a desired central-angle phase has to be varied relative to an engine speed and a required engine torque. Then, variable phase control mechanism 71 is controlled responsively to a control signal corresponding to the desired central-angle phase map-retrieved based on latest up-to-date information regarding the engine speed and required engine torque. Variable lift and working-angle control mechanism 51 and variable phase control mechanism 71 can be controlled independently of each other.

Suppose a transient state from low engine operation to high engine operation, for example, in other words, in presence of a transition to an accelerating state, the intake-valve characteristic has to be changed from the state suited to part-load operation (see FIG. 3A) to the state suited to high-load operation (see FIG. 3B). That is, in the presence of the transition from low to high load, working angle $\theta$ has to be increased, while central-angle phase $\phi$ has to be retarded. As shown in FIGS. 4A and 4B, suppose that a variation of central-angle phase $\phi$ (in particular, a time rate of change of central-angle phase $\phi$) retards with respect to a variation of working angle $\theta$ (in particular, a time rate of change of working angle $\theta$) when increasingly compensating for working angle $\theta$ and retarding central-angle phase $\phi$. As can be appreciated from the intake-valve characteristic (see the intake-valve characteristic diagram shown below the time chart of 4B) at a certain point t1 of time shown in FIGS. 4A and 4B, intake-valve open timing IVO tends to excessively advance and therefore a valve overlap tends to become excessively large. This deteriorates the combustion stability.

As described hereinafter in detail, in order to avoid temporary mismatching between the time rate of change of working angle $\theta$ and the time rate of change of central-angle phase $\phi$ in specified transient states, the system of the embodiment can execute a synchronous control according to which the time rate of change in working angle $\theta$ and the time rate of change of central-angle phase $\phi$ are synchronized with each other.

In the shown embodiment, basically, it is possible to control the intake-air quantity by variably controlling the valve lift characteristic of intake valve 3 by means of variable valve operating device 2, instead of using the throttle of electronically-controlled throttle valve unit 18. Thus, the throttle opening of electronically-controlled throttle valve unit 18 is usually held at a predetermined constant value at which a predetermined negative pressure in collector 16 can be produced. The predetermined negative pressure in collector 16 is set to a predetermined minimum negative pressure of a negative pressure source, such as −50 mmHg. Fixing the throttle opening of electronically-controlled throttle valve unit 18 to the predetermined constant value corresponding to the predetermined collector pressure (the predetermined minimum negative pressure such as −50 mmHg) means an almost unthrottled condition (in other words, a slightly throttled condition). This greatly reduces a pumping loss of the engine. The predetermined minimum negative pressure (the predetermined vacuum) can be effectively used for recirculation of blowby gas in a blowby-gas recirculation system and/or canister purging in an evaporative emission control system, usually installed on practicable internal combustion engines. As set forth above, as a basic way to control the quantity of intake air, the variable intake-valve lift characteristic control is used. However, in an excessively low-speed and excessively low-load range in which the quantity of intake air is excessively small, the valve lift of intake valve 3 has to be finely controlled or adjusted to a very small lift. Such a fine adjustment of the intake-valve lift to the very small lift is very difficult, and thus there is a possibility of a slight deviation of the actual intake-valve lift from the desired valve lift (the very small lift). There is an increased tendency for a remarkable error in the intake-air quantity of each engine cylinder, that is, a remarkable error of the air/fuel mixture ratio to occur by way of the use of the variable intake-valve lift characteristic control in the excessively low-speed and excessively low-load range. To avoid this, in the excessively low-speed and excessively low-load range, the intake-valve lift characteristic is fixed constant, and in lieu thereof the throttle control is initiated via electronically-controlled throttle valve unit 18 so as to produce a desired intake-air quantity suited to the excessively low-speed and excessively low-load operation.

Figure 5:
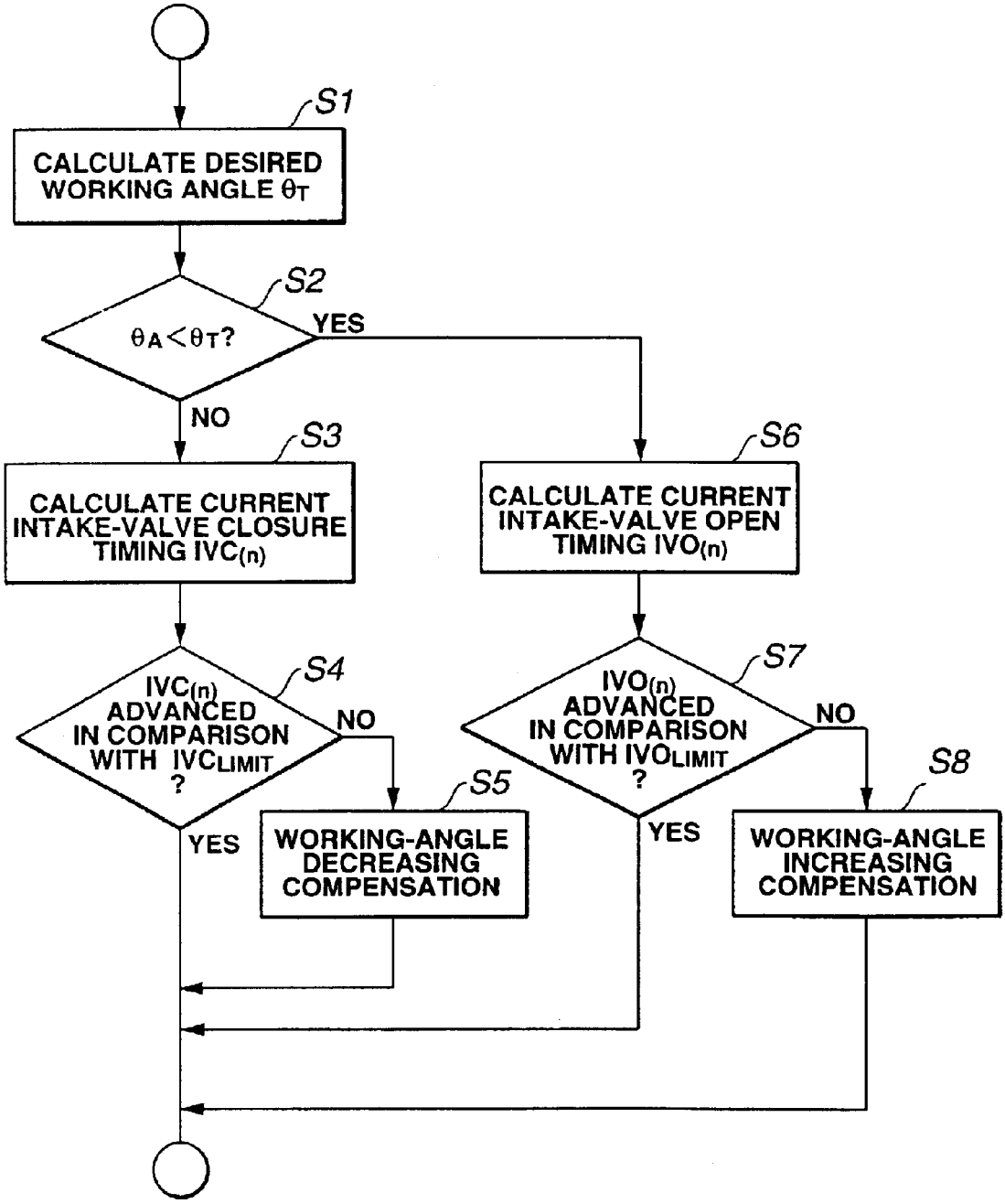
FIG. 5 is a flow chart illustrating a working angle θ control routine.
Figure 6:
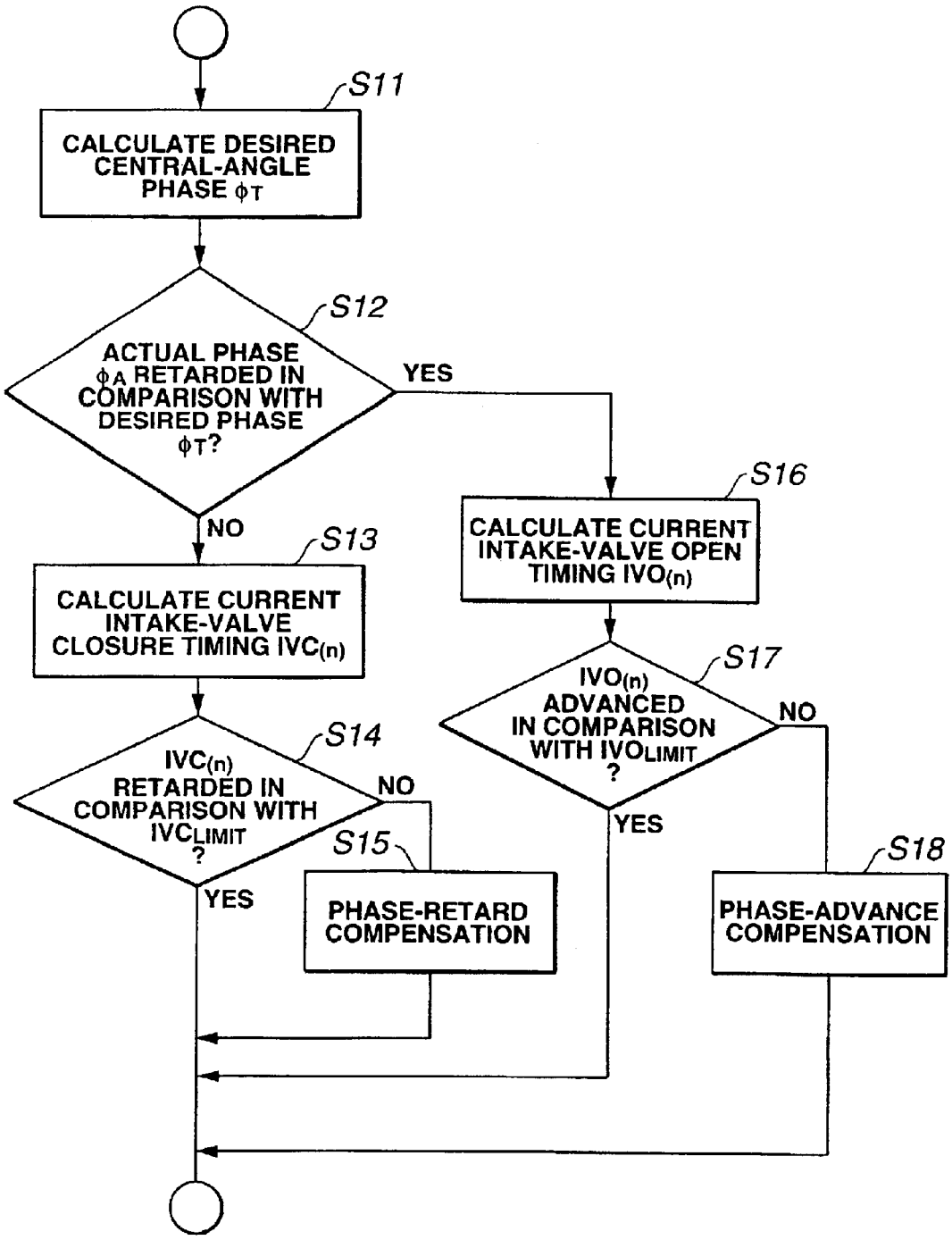
FIG. 6 is a flow chart illustrating a central-angle phase ϕ control routine.

The details of the synchronous control, according to which the time rate of change in working angle $\theta$ and the time rate of change of central-angle phase $\phi$ are synchronized with each other, are described in detail in reference to the flow charts shown in FIGS. 5 and 6. FIG. 5 shows the working angle $\theta$ control routine executed as time-triggered interrupt routines to be triggered every predetermined sampling time intervals, whereas FIG. 6 shows the central-angle phase $\phi$ control routine executed as time-triggered interrupt routines to be triggered every predetermined sampling time intervals.

First, at step S1 of FIG. 5, a desired working angle $\theta_T$ (a desired value of working angle $\theta$) is calculated or map-retrieved from the preprogrammed engine-speed versus engine torque versus desired working angle $\theta_T$ characteristic map.

At step S2, an actual working angle $\theta_A$ is compared to desired working angle $\theta_T$ map-retrieved through step S1. Concretely, a check is made to determine whether actual working angle $\theta_A$ is less than desired working angle $\theta_T$. Actual working angle $\theta_A$ is detected by means of control shaft sensor 64. When the answer to step S2 is in the negative (NO), that is, $\theta_A \geqq \theta_T$, the processor of ECU 19 determines that the working angle has to be decreasingly compensated for. Thus, in case of $\theta_A \geqq \theta_T$, the routine proceeds from step S2 via step S3 to step S4.

At step S3, a current value $IVC_{(n)}$ of intake-valve closure timing IVC is calculated. The current intake-valve closure timing $IVC_{(n)}$ is actually calculated based on actual working angle $\theta_A$, which is detected by control shaft sensor 64, and an actual central-angle phase $\phi_A$, which is detected by drive shaft sensor 66.

At step S4, a check is made to determine whether the current intake-valve closure timing $IVC_{(n)}$ calculated through step S3 is advanced in comparison with a predetermined intake-valve closure timing limit $IVC_{LIMIT}$. When the answer to step S4 is affirmative (YES), ECU 19 disables the working angle to be decreasingly compensated for, that is, the decreasing compensation for the working angle is inhibited. Conversely when the answer to step S4 is negative (NO), ECU 19 determines that it is necessary to decreasingly compensate for the working angle, and thus the routine proceeds from step S4 to step S5.

At step S5, ECU 19 enables the working angle to be decreasingly compensated for. Concretely, a working-angle decreasing compensation indicative command is output from the output interface of ECU 19 to first actuator 63 for variable lift and working-angle control mechanism 51. According to the working-angle decreasing compensation, the working angle is decremented by a predetermined decrement (a very small working angle) each control cycle, and thus gradually moderately reduced during subsequent executions of the working angle θ control routine. As can be appreciated from the flow from step S1 through steps S2, S3 and S4 to step S5, in case of $\theta_A \geqq \theta_T$, the time rate of decrease of working angle θ can be properly limited, so that intake-valve closure timing IVC is prevented from being advanced in comparison with predetermined intake-valve closure timing limit $IVC_{LIMIT}$. In more detail, the time rate of decrease of working angle θ can be properly limited by limiting intake-valve closure timing IVC by predetermined intake-valve closure timing limit $IVC_{LIMIT}$, such that intake-valve closure timing IVC slowly moderately approaches to predetermined intake-valve closure timing limit $IVC_{LIMIT}$, while preventing intake-valve closure timing IVC from being advanced in comparison with predetermined intake-valve closure timing limit $IVC_{LIMIT}$.

On the contrary, when the answer to step S2 is in the affirmative (YES), that is, $\theta_A < \theta_T$, the processor of ECU 19 determines that the working angle has to be increasingly compensated for. Thus, in case of $\theta_A < \theta_T$, the routine proceeds from step S2 via step S6 to step S7.

At step S6, a current value $IVO_{(n)}$ of intake-valve open timing IVO is calculated. The current intake-valve open timing $IVO_{(n)}$ is actually calculated based on actual working angle $\theta_A$, detected by control shaft sensor 64, and actual central-angle phase $\phi_A$, detected by drive shaft sensor 66.

At step S7, a check is made to determine whether the current intake-valve open timing $IVO_{(n)}$ calculated through step S6 is advanced in comparison with a predetermined intake-valve open timing limit $IVO_{LIMIT}$. When the answer to step S7 is affirmative (YES), that is, when current intake-valve open timing $IVO_{(n)}$ is advanced in comparison with predetermined intake-valve open timing limit $IVO_{LIMIT}$, ECU 19 disables the working angle to be increasingly compensated for, that is, the increasing compensation for the working angle is inhibited. Conversely when the answer to step S7 is negative (NO), that is, when current intake-valve open timing $IVO_{(n)}$ is not advanced in comparison with predetermined intake-valve open timing limit $IVO_{LIMIT}$, ECU 19 determines that it is necessary to increasingly compensate for the working angle, and thus the routine proceeds from step S7 to step S8.

At step S8, ECU 19 enables the working angle to be increasingly compensated for. Concretely, a working-angle increasing compensation indicative command is output from the output interface of ECU 19 to first actuator 63 for variable lift and working-angle control mechanism 51. According to the working-angle increasing compensation, the working angle is incremented by a predetermined increment (a very small working angle) each control cycle, and thus gradually moderately increased during subsequent executions of the working angle θ control routine. As can be appreciated from the flow from step S1 through steps S2, S6 and S7 to step S8, in case of $\theta_A < \theta_T$, the time rate of increase of working angle θ can be properly limited, so that intake-valve open timing IVO is prevented from being advanced in comparison with predetermined intake-valve open timing limit $IVO_{LIMIT}$. In more detail, the time rate of increase of working angle θ can be properly limited by limiting intake-valve open timing IVO by predetermined intake-valve open timing limit $IVO_{LIMIT}$, such that intake-valve open timing IVO slowly moderately approaches to predetermined intake-valve open timing limit $IVO_{LIMIT}$, while preventing intake-valve open timing IVO from being advanced in comparison with predetermined intake-valve open timing limit $IVO_{LIMIT}$.

The previously-noted intake-valve open timing limit $IVO_{LIMIT}$ and intake-valve closure timing limit $IVC_{LIMIT}$ are set based on engine operating conditions. For instance, intake-valve opening timing limit $IVO_{LIMIT}$ is derived from or set based on allowable residual gas concentration, which is determined based on the intake-air quantity and engine speed. On the other hand, intake-valve closure timing limit $IVC_{LIMIT}$ is basically set to a desired intake-valve closure timing based on the current engine operating conditions, such as the current value of engine speed and the current value of required engine torque (that is, a desired intake-valve closure timing determined based on the previously-noted desired working angle $\theta_T$ and desired central-angle phase $\phi_T$). In the same manner as the aforementioned basic setting of intake-valve closure timing limit $IVC_{LIMIT}$, intake-valve open timing limit $IVO_{LIMIT}$ may be set to a desired intake-valve open timing based on the current engine operating conditions, such as the current value of engine speed and the current value of required engine torque (that is, a desired intake-valve open timing determined based on the previously-noted desired working angle $\theta_T$ and desired central-angle phase $\phi_T$). Alternatively, intake-valve open timing limit $IVO_{LIMIT}$ may be set to an intake-valve open timing slightly deviated from the desired intake-valve open timing by a predetermined crank angle, whereas intake-valve closure timing limit $IVC_{LIMIT}$ may be set to an intake-valve closure timing slightly deviated from the desired intake-valve closure timing by a predetermined crank angle.

Referring now to FIG. 6, there is shown the central-angle phase φ control routine executed in parallel with the working angle θ control routine of FIG. 5.

At step S11, a desired central-angle phase $\phi_T$ (a desired value of central-angle phase φ) is calculated or map-retrieved from the preprogrammed engine-speed versus engine torque versus desired central-angle phase $\phi_T$ characteristic map.

At step S12, an actual central-angle phase $\phi_A$ is compared to desired central-angle phase $\phi_T$ map-retrieved through step S11. Concretely, a check is made to determine whether actual central-angle phase $\phi_A$ is retarded in comparison with desired central-angle phase $\phi_T$. Actual central-angle phase $\phi_A$ is detected by means of drive shaft sensor 66. When the answer to step S12 is in the negative (NO), that is, when actual phase $\phi_A$ is advanced in comparison with desired phase $\phi_T$, the processor of ECU 19 determines that the central-angle phase has to be phase-retarded, and thus the routine proceeds from step S12 via step S13 to step S14.

At step S13, a current value $IVC_{(n)}$ of intake-valve closure timing IVC is calculated. The current intake-valve closure timing $IVC_{(n)}$ is actually calculated based on actual working angle $\theta_A$, detected by control shaft sensor 64, and actual central-angle phase $\phi_A$, detected by drive shaft sensor 66.

At step S14, a check is made to determine whether the current intake-valve closure timing $IVC_{(n)}$ calculated through step S13 is retarded in comparison with predetermined intake-valve closure timing limit $IVC_{LIMIT}$. When the answer to step S14 is affirmative (YES), ECU 19 disables the central-angle phase to be further phase-retarded, that is, the phase-retard compensation for the central-angle phase is inhibited. Conversely when the answer to step S14 is negative (NO), ECU 19 determines that it is necessary to retard the central-angle phase, and thus the routine proceeds from step S14 to step S15.

At step S15, ECU 19 enables the central-angle phase to be phase-retarded. Concretely, a phase-retard compensation indicative command is output from the output interface of ECU 19 to second actuator 73 for variable phase control mechanism 71. According to the phase-retard compensation, the central-angle phase is retarded by a predetermined crank angle (a very small crank angle) each control cycle, and thus gradually moderately retarded during subsequent executions of the central-angle phase $\phi$ control routine. As can be appreciated from the flow from step S11 through steps S12, S13 and S14 to step S15, in the phase-advanced state of actual phase $\phi_A$ from desired phase $\phi_T$, the time rate of phase-retard of central-angle phase $\phi$ can be properly limited, so that intake-valve closure timing IVC is prevented from being retarded in comparison with predetermined intake-valve closure timing limit $IVC_{LIMIT}$. In more detail, the time rate of phase-retard of central-angle phase $\phi$ can be properly limited by limiting intake-valve closure timing IVC by predetermined intake-valve closure timing limit $IVC_{LIMIT}$, such that intake-valve closure timing IVC slowly moderately approaches to predetermined intake-valve closure timing limit $IVC_{LIMIT}$, while preventing intake-valve closure timing IVC from being retarded in comparison with predetermined intake-valve closure timing limit $IVC_{LIMIT}$.

On the contrary, when the answer to step S12 is in the affirmative (YES), that is, when actual phase $\phi_A$ is retarded in comparison with desired phase $\phi_T$, the processor of ECU 19 determines that the central-angle phase has to be phase-advanced, and thus the routine proceeds from step S12 via step S16 to step S17.

At step S16, a current value $IVO_{(n)}$ of intake-valve open timing IVO is calculated. The current intake-valve open timing $IVO_{(n)}$ is actually calculated based on actual working angle $\theta_A$, detected by control shaft sensor 64, and actual central-angle phase $\phi_A$, detected by drive shaft sensor 66.

At step S17, a check is made to determine whether the current intake-valve open timing $IVO_{(n)}$ calculated through step S16 is advanced in comparison with predetermined intake-valve open timing limit $IVO_{LIMIT}$. When the answer to step S17 is affirmative (YES), ECU 19 disables the central-angle phase to be further phase-advanced, that is, the phase-advance compensation for the central-angle phase is inhibited. Conversely when the answer to step S17 is negative (NO), ECU 19 determines that it is necessary to advance the central-angle phase, and thus the routine proceeds from step S17 to step S18.

At step S18, ECU 19 enables the central-angle phase to be phase-advanced. Concretely, a phase-advance compensation indicative command is output from the output interface of ECU 19 to second actuator 73 for variable phase control mechanism 71. According to the phase-advance compensation, the central-angle phase is advanced by a predetermined crank angle (a very small crank angle) each control cycle, and thus gradually moderately advanced during subsequent executions of the central-angle phase $\phi$ control routine. As can be appreciated from the flow from step S11 through steps S12, S16 and S17 to step S18, in the phase-retarded state of actual phase $\phi_A$ from desired phase $\phi_T$, the time rate of phase-advance of central-angle phase $\phi$ can be properly limited, so that intake-valve open timing IVO is prevented from being advanced in comparison with predetermined intake-valve open timing limit $IVO_{LIMIT}$. In more detail, the time rate of phase-advance of central-angle phase $\phi$ can be properly limited by limiting intake-valve open timing IVO by predetermined intake-valve open timing limit $IVO_{LIMIT}$, such that intake-valve open timing IVO slowly moderately approaches to predetermined intake-valve open timing limit $IVO_{LIMIT}$, while preventing intake-valve open timing IVO from being advanced in comparison with predetermined intake-valve open timing limit $IVO_{LIMIT}$.

The previously-noted intake-valve open timing limit $IVO_{LIMIT}$ and intake-valve closure timing limit $IVC_{LIMIT}$, which are used for the central-angle phase $\phi$ control routine shown in FIG. 6, may be set to be identical to respective timing limits $IVO_{LIMIT}$ and $IVC_{LIMIT}$, which are used for the working angle $\theta$ control routine shown in FIG. 5. Alternatively, intake-valve open timing limit $IVO_{LIMIT}$ and intake-valve closure timing limit $IVC_{LIMIT}$, which are used for the central-angle phase $\phi$ control routine shown in FIG. 6, may be set to be different from respective timing limits $IVO_{LIMIT}$ and $IVC_{LIMIT}$, which are used for the working angle $\theta$ control routine shown in FIG. 5.

As will be appreciated from the above, according to the system of the embodiment, the working angle $\theta$ control routine of FIG. 5 and the central-angle phase $\phi$ control routine of FIG. 6 are simultaneously executed in parallel with each other. During simultaneous executions of the working angle $\theta$ control routine of FIG. 5 and the central-angle phase $\phi$ control routine of FIG. 6, assuming that a time rate of change of working angle $\theta$ is limited according to the working angle $\theta$ control routine (see the flow from step S4 to step S5 or the flow from step S7 to step S8 in FIG. 5), a change in central-angle phase $\phi$ with respect to t (time) tends to progress relative to a change in working angle $\theta$ with respect to t. That is to say, when a phase-change in central-angle phase $\phi$ retards relatively in comparison with a change in working angle $\theta$ for some reason, a time rate of change of working angle $\theta$ is properly limited by limiting intake-valve closure timing IVC (or intake-valve open timing IVO) by predetermined intake-valve closure timing limit $IVC_{LIMIT}$ (or predetermined intake-valve open timing limit $IVO_{LIMIT}$), and therefore the system of the embodiment operates to wait for a phase-change in central-angle phase $\phi$ to progress for a time period during which the time rate of change of working angle $\theta$ is limited. As a consequence, the working angle $\theta$ control and the central-angle phase $\phi$ control are synchronously executed so that the time rate of change in working angle $\theta$ and the time rate of change of central-angle phase $\phi$ are synchronized with each other, and thus an undesired abnormal valve timing is avoided from being created.

Figure 7A:
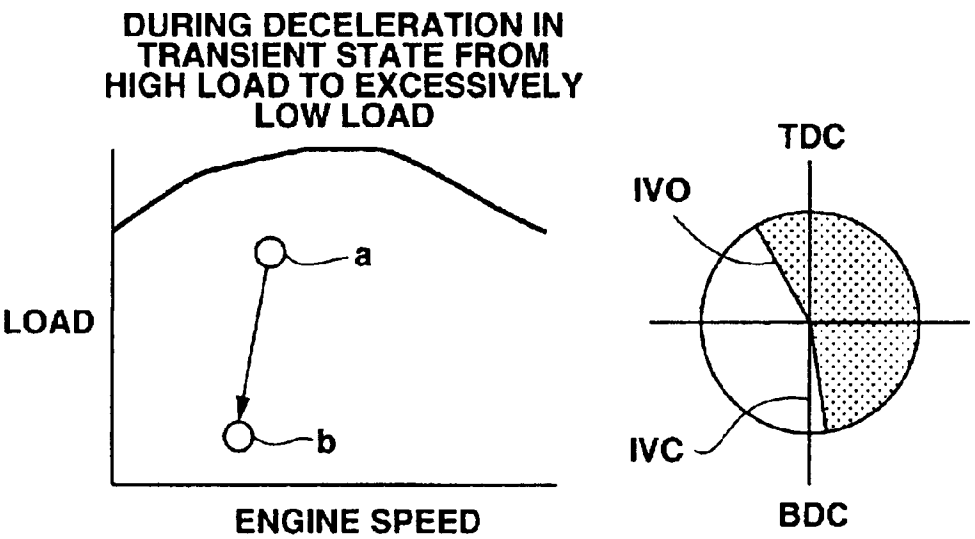
FIGS. 7A and 7B are intake-valve characteristic diagrams showing IVO, IVC, θ, and ϕ, during deceleration in a second transient state from high (see FIG. 7A) to excessively low load (see FIG. 7B).
Figure 7B:
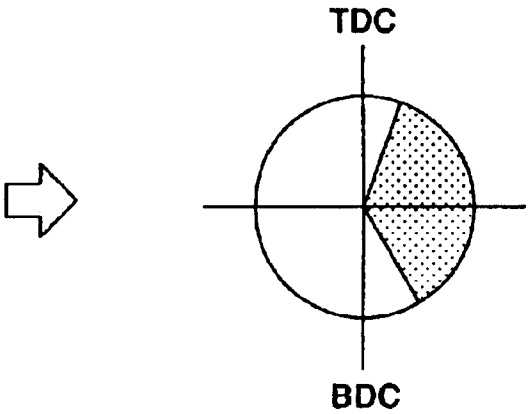

Referring now to FIGS. 7A and 7B, there are shown intake-valve open timing IVO and intake-valve closure timing IVC, both determined by a combination of working angle $\theta$ controlled by variable lift and working-angle control mechanism 51 and central-angle phase $\phi$ controlled by variable phase control mechanism 71, during deceleration in a transient state from high load operation (see the operating point "a" and the intake-valve characteristic diagram of FIG. 7A) to excessively low load operation (see the operating point "b" and the intake-valve characteristic diagram of FIG. 7B). As appreciated from comparison of working angle $\theta$ from intake-valve open timing IVO to intake-valve closure timing IVC and central-angle phase $\phi$ (corresponding to the central angle between a crank angle of IVO and a crank angle of IVC) shown in FIG. 7A (during high load) with those shown in FIG. 7B (during excessively low load), during the transition from the operating point "a" to the operating point "b", central-angle phase $\phi$ has to be retarded, while working angle θ decreases. FIGS. 8A, 8B, and 8C respectively show variations of working angle θ, central-angle phase ϕ, and intake-valve closure timing IVC, obtained with no synchronous control for working angle and phase during deceleration in the transient state from the operating point "a" (high load operation) to the operating point "b" (excessively low load operation). Characteristic curves indicated by solid lines in FIGS. 8A-8C show an ideal working angle θ characteristic, an ideal central-angle phase ϕ characteristic, and an ideal intake-valve closure timing IVC characteristic, respectively. On the other hand, characteristic curves indicated by phantom lines in FIGS. 8B and 8C show an undesired central-angle phase ϕ characteristic, and an undesired intake-valve closure timing IVC characteristic, respectively occurring for some reason. Assuming that the phase-retard of central-angle phase ϕ is time-delayed (see the phantom line of FIG. 8B) with respect to its desired phase indicated by the solid line in FIG. 8B in absence of the synchronous control, there is an increased tendency for intake-valve closure timing IVC to advance (see the overshot portion of IVC exceeding $IVC_{LIMIT}$ in FIG. 8C) with respect to its desired intake-valve closure timing (that is, predetermined intake-valve closure timing limit $IVC_{LIMIT}$) due to a decrease in working angle θ. This results in a lack of the quantity of intake air entering the engine cylinder, and thus engine stall may occur. On the other hand, FIGS. 9A, 9B, and 9C respectively show variations of working angle θ, central-angle phase ϕ, and intake-valve closure timing IVC, obtained with the synchronous control for working angle and phase during deceleration in the transient state from the operating point "a" (high load operation) to the operating point "b" (excessively low load operation). Assuming that the phase-retard of central-angle phase ϕ is time-delayed (see the phantom line of FIG. 9B) with respect to its desired phase indicated by the solid line in FIG. 9B in presence of the synchronous control, intake-valve closure timing IVC is limited by predetermined intake-valve closure timing limit $IVC_{LIMIT}$ and thus the time rate of decrease of working angle θ is decreasingly compensated for and as a result intake-valve closure timing IVC slowly approaches to predetermined intake-valve closure timing limit $IVC_{LIMIT}$, while preventing intake-valve closure timing IVC from being advanced from predetermined intake-valve closure timing limit $IVC_{LIMIT}$ (see the flow from step S4 to step S5 in FIG. 5). As a result of this, working angle θ changes in accordance with the characteristic curve indicated by the phantom line in FIG. 9A in synchronism with a change in central-angle phase ϕ (see the phantom line in FIG. 9B). Then, intake-valve closure timing IVC is maintained at predetermined intake-valve closure timing limit $IVC_{LIMIT}$ (see FIG. 9C).

Figure 10A:
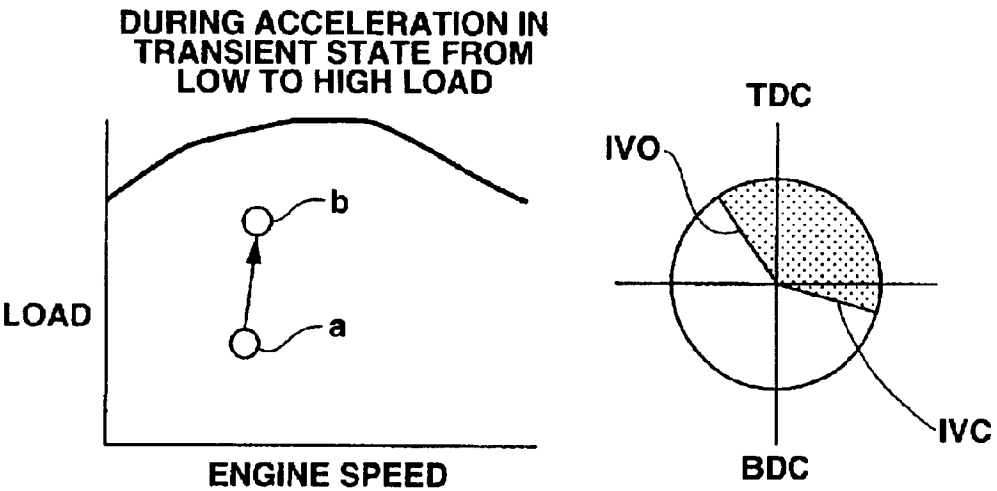
FIGS. 10A and 10B are intake-valve characteristic diagrams showing IVO, IVC, θ, and ϕ, during acceleration in a third transient state from low (see FIG. 10A) to high load (see FIG. 10B).
Figure 10B:
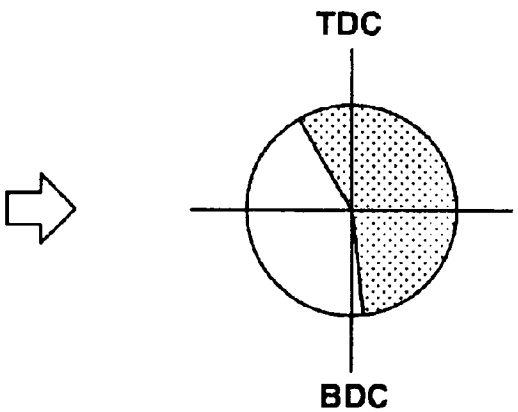

Referring now to FIGS. 10A and 10B, there are shown intake-valve open timing IVO and intake-valve closure timing IVC, both determined by a combination of working angle θ control and central-angle phase ϕ control, during acceleration in a transient state from low load operation (see the operating point "a" and the intake-valve characteristic diagram of FIG. 10A) to high load operation (see the operating point "b" and the intake-valve characteristic diagram of FIG. 10B). As appreciated from comparison of working angle θ from IVO to IVC and central-angle phase ϕ (corresponding to the central angle between IVO and IVC) shown in FIG. 10A (during low load) with those shown in FIG. 10B (during high load), central-angle phase ϕ has to be retarded, while working angle θ increases. FIGS. 11A, 11B, and 11C respectively show variations of working angle θ, central-angle phase ϕ, and intake-valve open timing IVO, obtained with no synchronous control for working angle and phase during acceleration in the transient state from the operating point "a" (low load operation) to the operating point "b" (high load operation). Characteristic curves indicated by solid lines in FIGS. 11A-11C show an ideal working angle θ characteristic, an ideal central-angle phase ϕ characteristic, and an ideal intake-valve open timing IVO characteristic, respectively. On the other hand, characteristic curves indicated by phantom lines in FIGS. 11B and 11C show an undesired central-angle phase ϕ characteristic, and an undesired intake-valve open timing IVO characteristic, respectively occurring for some reason. Assuming that the phase-retard of central-angle phase ϕ is time-delayed (see the phantom line of FIG. 11B) with respect to its desired phase indicated by the solid line in FIG. 11B in absence of the synchronous control, there is an increased tendency for intake-valve open timing IVO to advance (see the overshot portion of IVO exceeding $IVO_{LIMIT}$ in FIG. 11C) with respect to its desired intake-valve open timing (that is, predetermined intake-valve open timing limit $IVO_{LIMIT}$) due to an increase in working angle θ. This results in an excessive valve overlap, and thus combustion stability may temporarily deteriorate. On the other hand, FIGS. 12A, 12B, and 12C respectively show variations of working angle θ, central-angle phase ϕ, and intake-valve open timing IVO, obtained with the synchronous control for working angle and phase during acceleration in the transient state from the operating point "a" (low load operation) to the operating point "b" (high load operation). Assuming that the phase-retard of central-angle phase ϕ is time-delayed (see the phantom line of FIG. 12B) with respect to its desired phase indicated by the solid line in FIG. 12B in presence of the synchronous control, intake-valve open timing IVO is limited by predetermined intake-valve open timing limit $IVO_{LIMIT}$ and thus the time rate of increase of working angle θ is decreasingly compensated for and as a result intake-valve open timing IVO slowly approaches to predetermined intake-valve open timing limit $IVO_{LIMIT}$, while preventing intake-valve open timing IVO from being advanced from predetermined intake-valve open timing limit $IVO_{LIMIT}$ (see the flow from step S7 to step S8 in FIG. 5). As a result of this, working angle θ changes in accordance with the characteristic curve indicated by the phantom line in FIG. 12A in synchronism with a change in central-angle phase ϕ (see the phantom line in FIG. 12B). Then, intake-valve open timing IVO is maintained at predetermined intake-valve open timing limit $IVO_{LIMIT}$ (see FIG. 12C).

Figure 13A:
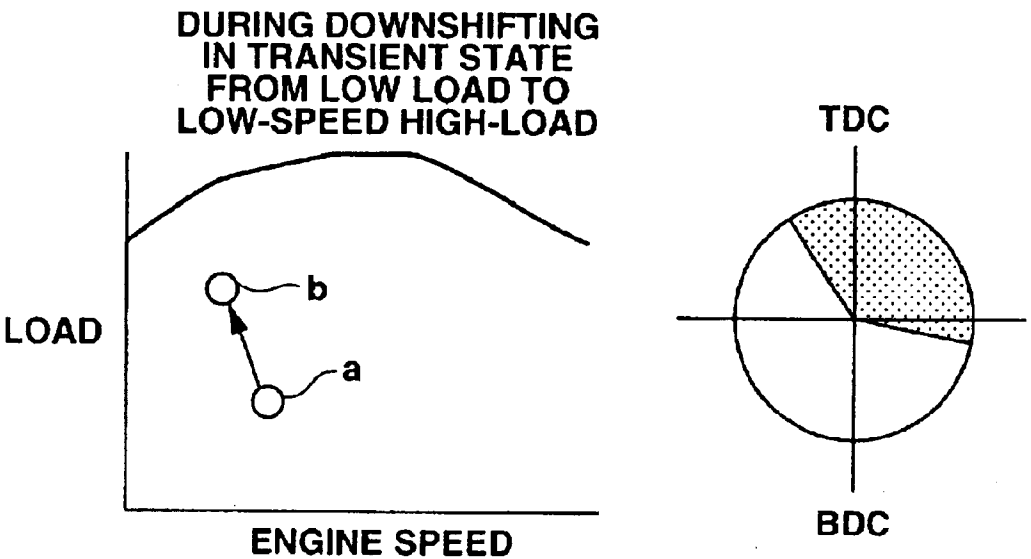
FIGS. 13A and 13B are intake-valve characteristic diagrams showing IVO, IVC, θ, and ϕ, during a downshift in a fourth transient state from low load (see FIG. 13A) to low-speed and high-load (see FIG. 13B).
Figure 13B:
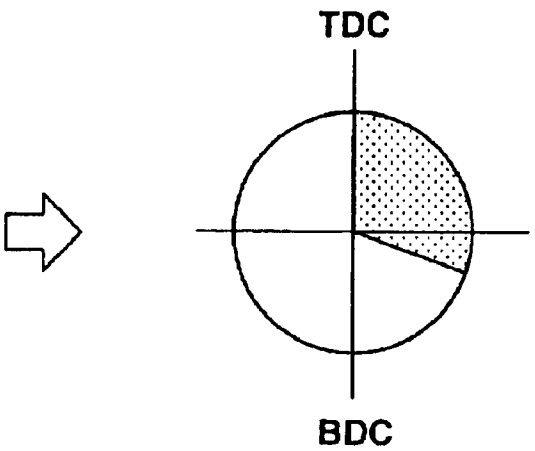

Referring now to FIGS. 13A and 13B, there are shown intake-valve open timing IVO and intake-valve closure timing IVC, both determined by a combination of working angle θ control and central-angle phase ϕ control, during downshifting in a transient state from low load operation (see the operating point "a" and the intake-valve characteristic diagram of FIG. 13A) to low-speed high-load operation (see the operating point "b" and the intake-valve characteristic diagram of FIG. 13B). As appreciated from comparison of working angle θ from IVO to IVC and central-angle phase ϕ (corresponding to the central angle between IVO and IVC) shown in FIG. 13A (during low load operation) with those shown in FIG. 13B (during low-speed and high-load operation), central-angle phase ϕ has to be retarded, while working angle θ decreases. FIGS. 14A, 14B, and 14C respectively show variations of working angle θ, central-angle phase ϕ, and intake-valve closure timing IVC, obtained with no synchronous control for working angle and phase during downshifting in the transient state from the operating point "a" (low load operation) to the operating point "b" (low-speed high-load operation). Characteristic curves indicated by solid lines in FIGS. 14A-14C show an ideal working angle θ characteristic, an ideal central-angle phase ϕ characteristic, and an ideal intake-valve closure timing IVC characteristic, respectively. On the other hand, characteristic curves indicated by phantom lines in FIGS. 14A and 14C show an undesired working angle θ characteristic, and an undesired intake-valve closure timing IVC characteristic, respectively occurring for some reason. Assuming that the decrease of working angle θ is time-delayed (see the phantom line of FIG. 14A) in comparison with its desired working angle indicated by the solid line in FIG. 14A in absence of the synchronous control, there is an increased tendency for intake-valve closure timing IVC to retard (see the undershot portion of IVC undershooting $IVC_{LIMIT}$ in FIG. 14C) with respect to its desired intake-valve closure timing (that is, predetermined intake-valve closure timing limit $IVC_{LIMIT}$) due to a phase-retard of central-angle phase ϕ. This results in abnormal torque fluctuations. On the other hand, FIGS. 15A, 15B, and 15C respectively show variations of working angle θ, central-angle phase ϕ, and intake-valve closure timing IVC, obtained with the synchronous control for working angle and phase during downshifting in the transient state from the operating point "a" (low load operation) to the operating point "b" (low-speed high-load operation). Assuming that the decrease of working angle θ is time-delayed (see the phantom line of FIG. 15A) in comparison with its desired working angle indicated by the solid line in FIG. 15A in presence of the synchronous control, intake-valve closure timing IVC is limited by predetermined intake-valve closure timing limit $IVC_{LIMIT}$ and thus the time rate of phase-retard of central-angle phase ϕ is decreasingly compensated for and as a result intake-valve closure timing IVC slowly approaches to predetermined intake-valve closure timing limit $IVC_{LIMIT}$, while preventing intake-valve closure timing IVC from being retarded from predetermined intake-valve closure timing limit $IVC_{LIMIT}$ (see the flow from step S14 to step S15 in FIG. 6). As a result of this, central-angle phase ϕ changes in accordance with the characteristic curve indicated by the phantom line in FIG. 15B in synchronism with a change in working angle θ (see the phantom line in FIG. 15A). Then, intake-valve closure timing IVC is maintained at predetermined intake-valve closure timing limit $IVC_{LIMIT}$ (see FIG. 15C).

Figure 16A:
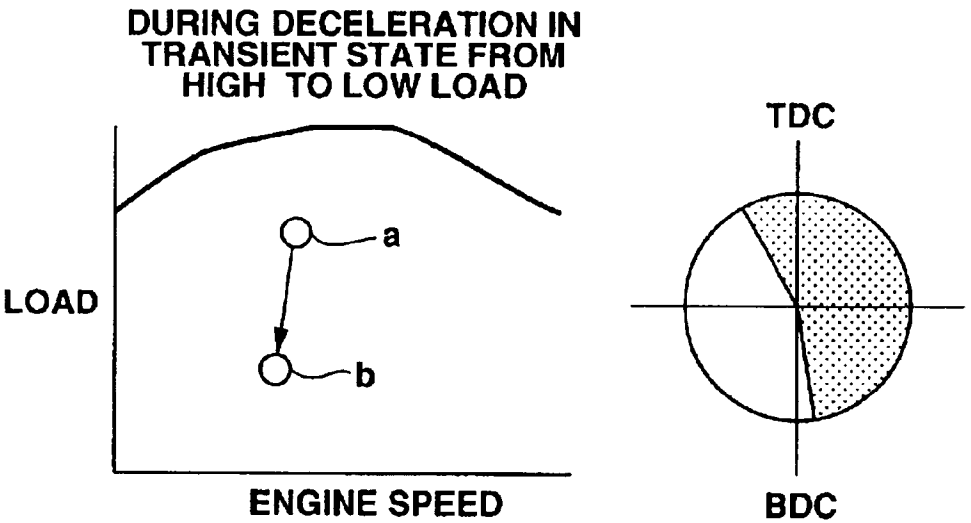
FIGS. 16A and 16B are intake-valve characteristic diagrams showing IVO, IVC, θ, and ϕ, during deceleration in a fifth transient state from high (see FIG. 16A) to low load (see FIG. 16B).
Figure 16B:
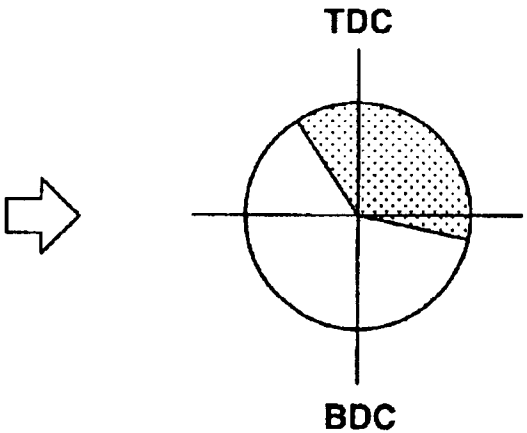

Referring now to FIGS. 16A and 16B, there are shown intake-valve open timing IVO and intake-valve closure timing IVC, both determined by a combination of working angle θ control and central-angle phase ϕ control, during deceleration in a transient state from high load operation (see the operating point "a" and the intake-valve characteristic diagram of FIG. 16A) to low load operation (see the operating point "b" and the intake-valve characteristic diagram of FIG. 16B). As appreciated from comparison of working angle θ from IVO to IVC and central-angle phase ϕ (corresponding to the central angle between IVO and IVC) shown in FIG. 16A (during high load operation) with those shown in FIG. 16B (during low load operation), central-angle phase ϕ has to be advanced, while working angle θ decreases. FIGS. 17A, 17B, and 17C respectively show variations of working angle θ, central-angle phase ϕ, and intake-valve open timing IVO, obtained with no synchronous control for working angle and phase during deceleration in the transient state from the operating point "a" (high load operation) to the operating point "b" (low load operation). Characteristic curves indicated by solid lines in FIGS. 17A-17C show an ideal working angle θ characteristic, an ideal central-angle phase ϕ characteristic, and an ideal intake-valve open timing IVO characteristic, respectively. On the other hand, characteristic curves indicated by phantom lines in FIGS. 17A and 17C show an undesired working angle θ characteristic, and an undesired intake-valve open timing IVO characteristic, respectively occurring for some reason. Assuming that the decrease of working angle θ is time-delayed (see the phantom line of FIG. 17A) in comparison with its desired working angle indicated by the solid line in FIG. 17A in absence of the synchronous control, there is an increased tendency for intake-valve open timing IVO to advance (see the overshot portion of IVO overshooting $IVO_{LIMIT}$ in FIG. 17C) with respect to its desired intake-valve open timing (that is, predetermined intake-valve open timing limit $IVO_{LIMIT}$) due to a phase-advance of central-angle phase ϕ. This results in an excessive valve overlap, and thus combustion stability may temporarily deteriorate. On the other hand, FIGS. 18A, 18B, and 18C respectively show variations of working angle θ, central-angle phase ϕ, and intake-valve open timing IVO, obtained with the synchronous control for working angle and phase during deceleration in the transient state from the operating point "a" (high load operation) to the operating point "b" (low load operation). Assuming that the decrease of working angle θ is time-delayed (see the phantom line of FIG. 18A) in comparison with its desired working angle indicated by the solid line in FIG. 18A in presence of the synchronous control, intake-valve open timing IVO is limited by predetermined intake-valve open timing limit $IVO_{LIMIT}$ and thus the time rate of phase-advance of central-angle phase ϕ is decreasingly compensated for and as a result intake-valve open timing IVO slowly approaches to predetermined intake-valve open timing limit $IVO_{LIMIT}$, while preventing intake-valve open timing IVO from being advanced from predetermined intake-valve open timing limit $IVO_{LIMIT}$ (see the flow from step S17 to step S18 in FIG. 6). As a result of this, central-angle phase ϕ changes in accordance with the characteristic curve indicated by the phantom line in FIG. 18B in synchronism with a change in working angle θ (see the phantom line in FIG. 18A). Then, intake-valve open timing IVO is maintained at predetermined intake-valve open timing limit $IVO_{LIMIT}$ (see FIG. 18C).

As a variable working-angle control mechanism, the system of the shown embodiment uses variable lift and working-angle control mechanism 51 (see FIG. 2), capable of scaling up and down both the valve lift and the working angle continuously simultaneously. In lieu thereof, another type of working-angle control mechanism, in which a maximum valve lift is fixed constant and only a working angle is variably controlled, may be used.

The entire contents of Japanese Patent Application No. 2002-211993 (filed Jul. 22, 2002) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable intake-valve operating system for an engine enabling a working angle of an intake valve and a phase at a maximum lift point of the intake valve to be varied, comprising:

a variable working-angle control mechanism capable of continuously changing the working angle of the intake valve;

a variable phase control mechanism capable of continuously changing the phase of the intake valve;

a control unit being configured to be electronically connected to both the variable working-angle control mechanism and the variable phase control mechanism, to simultaneously control the variable working-angle control mechanism and the variable phase control mechanism responsively to a desired working angle and a desired phase both based on an engine operating condition; and the control unit executing a synchronous control that a time rate of change of the working angle and a time rate of change of the phase are synchronized with each other in a transient state that the engine operating condition changes, wherein a time rate of increase of the working angle is limited in the transient state, so that an intake-valve open timing is prevented from being advanced in comparison with a predetermined intake-valve open timing limit set based on the engine operating condition.

2. The variable intake-valve operating system as claimed in claim 1, further comprising:

a first detector that detects a current value of the working angle changed by the variable working-angle control mechanism; and a second detector that detects a current value of the phase changed by the variable phase control mechanism; and wherein a latest up-to-date information data regarding the intake-valve open timing is calculated based on both the current value of the working angle and the current value of the phase.

3. The variable intake-valve operating system as claimed in claim 1, further comprising:

a first detector that detects a current value of the working angle changed by the variable working-angle control mechanism; and a second detector that detects a current value of the phase changed by the variable phase control mechanism; and wherein the predetermined intake-valve open timing limit is set to be identical to a desired intake-valve open timing determined based on the desired working angle and the desired phase.

4. The variable intake-valve operating system as claimed in claim 1, wherein:

the time rate of increase of the working angle is limited in the transient state by limiting the intake-valve open timing by the predetermined intake-valve open timing limit set based on the engine operating condition, so that the intake-valve open timing moderately approaches to the predetermined intake-valve open timing limit, while preventing the intake-valve open timing from being advanced in comparison with the predetermined intake-valve open timing limit.

5. The variable intake-valve operating system as claimed in claim 1, wherein:

the time rate of increase of the working angle is limited during acceleration in a transient state from low load operation to high load operation by limiting the intake-valve open timing by the predetermined intake-valve open timing limit set based on the engine operating condition, so that the intake-valve open timing moderately approaches to the predetermined intake-valve open timing limit, while preventing the intake-valve open timing from being advanced in comparison with the predetermined intake-valve open timing limit.

6. A variable intake-valve operating system for an engine enabling a working angle of an intake valve and a phase at a maximum lift point of the intake valve to be varied, comprising:

a variable working-angle control mechanism capable of continuously changing the working angle of the intake valve;

a variable phase control mechanism capable of continuously changing the phase of the intake valve;

a control unit being configured to be electronically connected to both the variable working-angle control mechanism and the variable phase control mechanism, to simultaneously control the variable working-angle control mechanism and the variable phase control mechanism responsively to a desired working angle and a desired phase both based on an engine operating condition; and the control unit executing a synchronous control that a time rate of change of the working angle and a time rate of change of the phase are synchronized with each other in a transient state that the engine operating condition changes, wherein a time rate of phase-advance of the phase is limited in the transient state, so that an intake-valve open timing is prevented from being advanced in comparison with a predetermined intake-valve open timing limit set based on the engine operating condition.

7. The variable intake-valve operating system as claimed in claim 6, wherein:

the time rate of phase-advance of the phase is limited in the transient state by limiting the intake-valve open timing by the predetermined intake-valve open timing limit set based on the engine operating condition, so that the intake-valve open timing moderately approaches to the predetermined intake-valve open timing limit, while preventing the intake-valve open timing from being advanced in comparison with the predetermined intake-valve open timing limit.

8. The variable intake-valve operating system as claimed in claim 6, wherein:

the time rate of phase-advance of the phase is limited during deceleration in a transient state from high load operation to low load operation by limiting the intake-valve open timing by the predetermined intake-valve open timing limit set based on the engine operating condition, so that the intake-valve open timing moderately approaches to the predetermined intake-valve open timing limit, while preventing the intake-valve open timing from being advanced in comparison with the predetermined intake-valve open timing limit.

9. The variable intake-valve operating system as claimed in claim 6, further comprising:

a first detector that detects a current value of the working angle changed by the variable working-angle control mechanism; and a second detector that detects a current value of the phase changed by the variable phase control mechanism, wherein a latest up-to-date information data regarding the intake-valve open timing is calculated based on both the current value of the working angle and the current value of the phase.

10. The variable intake-valve operating system as claimed in claim 6, further comprising:

a first detector that detects a current value of the working angle changed by the variable working-angle control mechanism; and a second detector that detects a current value of the phase changed by the variable phase control mechanism, wherein the predetermined intake-valve open timing limit is set to be identical to a desired intake-valve open timing determined based on the desired working angle and the desired phase.

11. A variable intake-valve operating system for an engine enabling a working angle of an intake valve and a phase at a maximum lift point of the intake valve to be varied, comprising:

a variable working-angle control mechanism capable of continuously changing the working angle of the intake valve;

a variable phase control mechanism capable of continuously changing the phase of the intake valve;

a control unit being configured to be electronically connected to both the variable working-angle control mechanism and the variable phase control mechanism, to simultaneously control the variable working-angle control mechanism and the variable phase control mechanism responsively to a desired working angle and a desired phase both based on an engine operating condition; and the control unit executing a synchronous control that a time rate of change of the working angle and a time rate of change of the phase are synchronized with each other in a transient state that the engine operating condition changes, wherein a time rate of decrease of the working angle is limited in the transient state, so that an intake-valve closure timing is prevented from being advanced in comparison with a predetermined intake-valve closure timing limit set based on the engine operating condition.

12. The variable intake-valve operating system as claimed in claim 11, further comprising:

a first detector that detects a current value of the working angle changed by the variable working-angle control mechanism; and a second detector that detects a current value of the phase changed by the variable phase control mechanism; and wherein a latest up-to-date information data regarding the intake-valve closure timing is calculated based on both the current value of the working angle and the current value of the phase.

13. The variable intake-valve operating system as claimed in claim 11, further comprising:

a first detector that detects a current value of the working angle changed by the variable working-angle control mechanism; and a second detector that detects a current value of the phase changed by the variable phase control mechanism; and wherein the predetermined intake-valve closure timing limit is set to be identical to a desired intake-valve closure timing determined based on the desired working angle and the desired phase.

14. The variable intake-valve operating system as claimed in claim 11, wherein:

the time rate of decrease of the working angle is limited in the transient state by limiting the intake-valve closure timing by the predetermined intake-valve closure timing limit set based on the engine operating condition, so that the intake-valve closure timing moderately approaches to the predetermined intake-valve closure timing limit, while preventing the intake-valve closure timing from being advanced in comparison with the predetermined intake-valve closure timing limit.

15. The variable intake-valve operating system as claimed in claim 11, wherein:

the time rate of decrease of the working angle is limited during deceleration in a transient state from high load operation to excessively low load operation by limiting the intake-valve closure timing by the predetermined intake-valve closure timing limit set based on the engine operating condition, so that the intake-valve closure timing moderately approaches to the predetermined intake-valve closure timing limit, while preventing the intake-valve closure timing from being advanced in comparison with the predetermined intake-valve closure timing limit.

16. A variable intake-valve operating system for an engine enabling a working angle of an intake valve and a phase at a maximum lift point of the intake valve to be varied, comprising:

a variable working-angle control mechanism capable of continuously changing the working angle of the intake valve;

a variable phase control mechanism capable of continuously changing the phase of the intake valve;

a control unit being configured to be electronically connected to both the variable working-angle control mechanism and the variable phase control mechanism, to simultaneously control the variable working-angle control mechanism and the variable phase control mechanism responsively to a desired working angle and a desired phase both based on an engine operating condition; and the control unit executing a synchronous control that a time rate of change of the working angle and a time rate of change of the phase are synchronized with each other in a transient state that the engine operating condition changes, wherein a time rate of phase-retard of the phase is limited in the transient state, so that an intake-valve closure timing is prevented from being retarded in comparison with a predetermined intake-valve closure timing limit set based on the engine operating condition.

17. The variable intake-valve operating system as claimed in claim 16, wherein:

the time rate of phase-retard of the phase is limited in the transient state by limiting the intake-valve closure timing by the predetermined intake-valve closure timing limit set based on the engine operating condition, so that the intake-valve closure timing moderately approaches to the predetermined intake-valve closure timing limit, while preventing the intake-valve closure timing from being retarded in comparison with the predetermined intake-valve closure timing limit.

18. The variable intake-valve operating system as claimed in claim 16, wherein:

the time rate of phase-retard of the phase is limited during downshifiing in a transient state from low load operation to low-speed high-load operation by limiting the intake-valve closure timing by the predetermined intake-valve closure timing limit set based on the engine operating condition, so that the intake-valve closure timing moderately approaches to the predetermined intake-valve closure timing limit, while preventing the intake-valve closure timing from being retarded in comparison with the predetermined intake-valve closure timing limit.

19. The variable intake-valve operating system as claimed in claim 16, further comprising:

a first detector that detects a current value of the working angle changed by the variable working-angle control mechanism; and a second detector that detects a current value of the phase changed by the variable phase control mechanism, wherein a latest up-to-date information data regarding the intake-valve closure timing is calculated based on both the current value of the working angle and the current value of the phase.

20. The variable intake-valve operating system as claimed in claim 16, further comprising:

a first detector that detects a current value of the working angle changed by the variable working-angle control mechanism; and a second detector that detects a current value of the phase changed by the variable phase control mechanism, wherein the predetermined intake-valve closure timing limit is set to be identical to a desired intake-valve closure timing determined based on the desired working angle and the desired phase.

21. A method of controlling a variable intake-valve operating system for an engine enabling a working angle of an intake valve and a phase at a maximum lift point of the intake valve to be varied continuously, the method comprising:

initiating a working angle control, so that the working angle is brought closer to a desired working angle;

initiating a phase control in parallel with the working angle control, so that the phase is brought closer to a desired phase; and executing a synchronous control between the working angle control and the phase control, so that a time rate of change of the working angle and a time rate of change of the phase are synchronized with each other in a transient state that an engine operating condition changes, wherein the working angle control comprises the steps of:

calculating the desired working angle based on the engine operating condition;

detecting a current value of the working angle;

detecting a current value of the phase;

comparing the desired working angle to the current value of the working angle;

calculating a latest up-to-date information data regarding an intake-valve closure timing based on both the current value of the working angle and the current value of the phase, when the current value of the working angle is greater than or equal to the desired working angle;

comparing the latest up-to-date information data regarding the intake-valve closure timing to a predetermined intake-valve closure timing limit;

enabling the working angle to be decreasingly compensated for when the latest up-to-date information data regarding the intake-valve closure timing is phase-retarded in comparison with the predetermined intake-valve closure timing limit, so that a time rate of decrease of the working angle is limited in the transient state by limiting the intake-valve closure timing by the predetermined intake-valve closure timing limit, so that the intake-valve closure timing moderately approaches to the predetermined intake-valve closure timing limit, while preventing the intake-valve closure timing from being advanced in comparison with the predetermined intake-valve closure timing limit;

calculating a latest up-to-date information data regarding an intake-valve open timing based on both the current value of the working angle and the current value of the phase, when the current value of the working angle is less than the desired working angle;

comparing the latest up-to-date information data regarding the intake-valve open timing to a predetermined intake-valve open timing limit; and enabling the working angle to be increasingly compensated for when the latest up-to-date information data regarding the intake-valve open timing is phase-retarded in comparison with the predetermined intake-valve open timing limit, so that a time rate of increase of the working angle is limited in the transient state by limiting the intake-valve open timing by the predetermined intake-valve open timing limit, so that the intake-valve open timing moderately approaches to the predetermined intake-valve open timing limit, while preventing the intake-valve open timing from being advanced in comparison with the predetermined intake-valve open timing limit, and wherein the phase control comprises the steps of;

calculating the desired phase based on the engine operating condition;

detecting the current value of the working angle;

detecting the current value of the phase;

comparing the desired phase to the current value of the phase;

calculating the latest up-to-date information data regarding the intake-valve closure timing based on both the current value of the working angle and the current value of the phase, when the current value of the phase is advanced in comparison with the desired phase;

comparing the latest up-to-date information data regarding the intake-valve closure timing to the predetermined intake-valve closure timing limit;

enabling the phase to be retarded when the latest up-to-date information data regarding the intake-valve closure timing is phase-advanced in comparison with the predetermined intake-valve closure timing limit, so that a time rate of phase-retard of the phase is limited in the transient state by limiting the intake-valve closure timing by the predetermined intake-valve closure timing limit, so that the intake-valve closure timing moderately approaches to the predetermined intake-valve closure timing limit, while preventing the intake-valve closure timing from being retarded in comparison with the predetermined intake-valve closure timing limit;

calculating the latest up-to-date information data regarding the intake-valve open timing based on both the current value of the working angle and the current value of the phase, when the current value of the phase is retarded in comparison with the desired phase;

comparing the latest up-to-date information data regarding the intake-valve open timing to the predetermined intake-valve open timing limit; and enabling the phase to be advanced when the latest up-to-date information data regarding the intake-valve open timing is phase-retarded in comparison with the predetermined intake-valve open timing limit, so that a time rate of phase-advance of the phase is limited in the transient state by limiting the intake-valve open timing by the predetermined intake-valve open timing limit, so that the intake-valve open timing moderately approaches to the predetermined intake-valve open timing limit, while preventing the intake-valve open timing from being advanced in comparison with the predetermined intake-valve open timing limit.

* * * * *